United States Patent [19]

Pardee

[11] 4,035,854

[45] July 19, 1977

[54] MATTRESS COVER

[76] Inventor: Marilynn Pardee, 1048 Pacific, San Francisco, Calif. 94133

[21] Appl. No.: 624,722

[22] Filed: Oct. 22, 1975

[51] Int. Cl.[2] ..... A47G 9/00

[52] U.S. Cl. ..... 5/334 C

[58] Field of Search ..... 5/334 R, 334 C, 335, 5/354 R, 354 B

[56] References Cited

U.S. PATENT DOCUMENTS

| | | | |
|---|---|---|---|
| 1,865,329 | 6/1932 | McHorter | 5/354 R X |
| 2,662,234 | 12/1953 | Citron | 5/334 C |
| 2,994,094 | 8/1961 | Hester | 5/334 C |
| 3,681,795 | 8/1972 | Palenske | 5/334 C |

*Primary Examiner*—Paul R. Gilliam
*Assistant Examiner*—Andrew M. Calvert

[57] ABSTRACT

A mattress cover is provided in which a fitted sheet for covering the mattress snugly is sewn to a plain sheet covering the fitted sheet along a line described by the foot of the mattress and a portion of the sides of the mattress, whereby the foot of the plain sheet does not become separated from the foot of the mattress during sleep.

1 Claim, 4 Drawing Figures

MATTRESS COVER

This invention relates to an improved mattress cover in which the top sheet does not become separated from the bottom sheet during the sleep of the user.

Conventional mattress covers utilize a pair of sheets which are tucked into the space between the mattress and the bed frame or the box spring. The upper sheet can be, and often is, separated from the mattress and the lower sheet by the movement of the user during sleep.

The present invention alleviates this problem by permanently attaching that edge of the top sheet which is typically tucked underneath the foot of the mattress to the lower edge of a fitted sheet which serves as the bottom sheet for the user.

The primary object of this invention is to provide a mattress cover in which the upper sheet is held firmly to the mattress to prevent dislodging thereof during the sleep of the user.

A further object of this invention is to provide an improved mattress cover which reduces the time of making the bed of the user.

A further object of this invention is to provide an improved mattress cover in which the upper sheet naturally hangs in an attractive and neatly-folded manner.

Further objects and advantages of the invention will appear from the following description of the preferred embodiment and from the drawings wherein.

Figure 1:
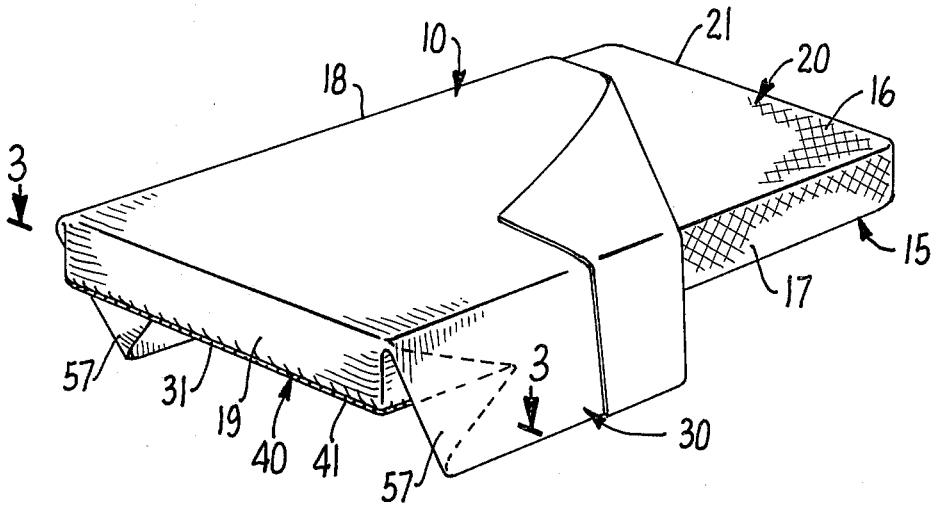
FIG. 1 is a top perspective view of the invention.

Referring to the drawings, FIG. 1 shows the mattress cover 10 of the invention which includes fitted sheet 20, upper sheet 30 and connecting means 40.

Fitted sheet 20 generally conforms to the surface of mattress 15, since fitted sheet 20 snugly covers the top surface 16, side surfaces 17 and 18, foot surface 19 and head surface 21 of mattress 15.

Plain sheet 30 covers fitted sheet 20.

Figure 2:
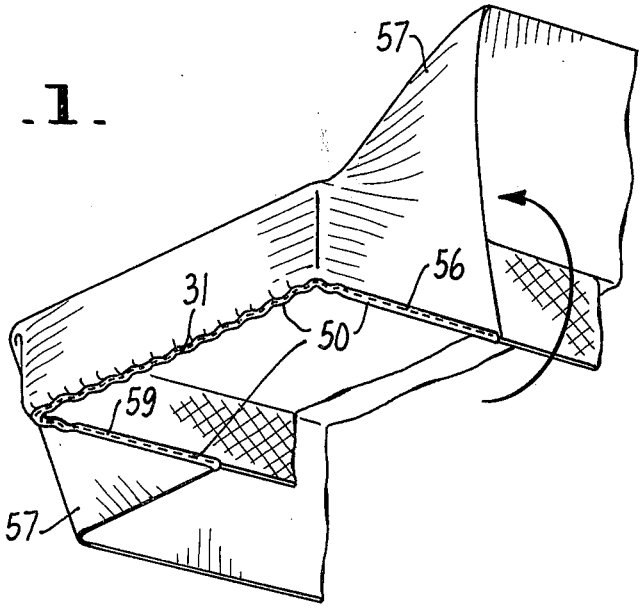
FIG. 2 is a bottom perspective view of the invention.
Figure 3:
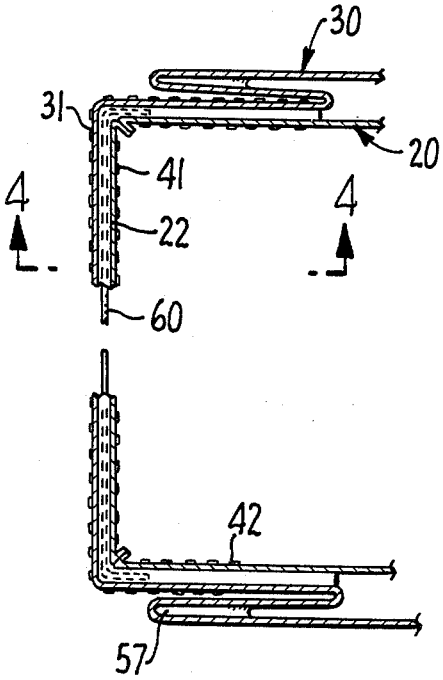
FIG. 3 is a sectional view of the invention along the line 3—3 of FIG. 1.
Figure 4:
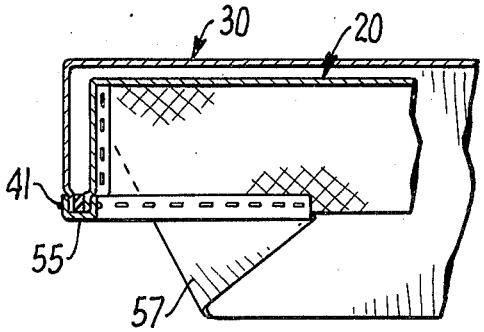
FIG. 4 is a sectional view of the invention along the line 4—4 of FIG. 3.

Connecting means 40, which in the embodiment shown, comprises stitching 41, attaches edge 31 of plain sheet 30 to the edge 22 of fitted sheet 20, as shown best in FIG. 3. The stitching 41 describes a generally C-shaped line 50 shown best in FIG. 2. C-shaped line 50 is described by the lower edge 55 of the foot surface 19 of mattress 15 and by the lower edges 56 and 57 of side surfaces 17 and 18, respectively, of mattress 15 adjacent foot surface 19.

The effect of the C-shaped line 50 is to create a natural, attractive fold 57 in that portion of plain sheet 30 adjacent the foot surface 19 of mattress 15. The fold 57 results from the stitching 42 and 43 which forms those portions 56 and 57 of the C-shaped line described by connecting means 40.

In use, the mattress cover 10 is applied to mattress 15 by applying fitted sheet 20 to mattress 15, the snug fit of fitted sheet 20 to mattress 15 is facilitated by elastic 60 carried in the lower edge of fitted sheet 20. Plain sheet 30 is then simply draped over fitted sheet 20. Fold 57 is created naturally by the C-shaped stitching which extends along the line described by the lower edge 31 of foot surface 19 of mattress 15 and portions 56 and 57 of side surfaces 17 and 18 of mattress 15. It is understood that C-shaped line 50 is actually displaced slightly from the edges of mattress 15, but C-shaped line 50 is generally described by the edges of mattress 15 referred to.

The mattress cover 10 reduces the time necessary to make the bed, is easily washed, and prevents the upper or plain sheet 30 from becoming separated from the lower or fitted sheet 20 and mattress 15 during sleep of the user.

I claim:

1. A mattress cover comprising a fitted sheet for snugly covering the top, side and foot and head surfaces of said mattress, a plain sheet for covering said fitted sheet, said plain sheet being wider than said fitted sheet; and connecting means permanently attaching an edge of said plain sheet to the edge of said fitted sheet along a C-shaped line described generally by the lower edge of said foot surface and by the lower edges of a portion of said side surfaces of said mattress adjacent said foot surface, whereby said plain sheet folds along a line extending from the end of said C-shaped line to the upper corner of the foot of said mattress, said mattress cover further comprising as elastic band in said fitted sheet extending along a portion of said C-shaped line.

* * * * *